United States Patent [19]

Jackson

[11] 4,359,134

[45] Nov. 16, 1982

[54] SOUND SUPPRESSOR FOR FLUID FLOW LINES

[75] Inventor: Barry N. Jackson, De Pere, Wis.

[73] Assignee: American Hospital Supply Corporation, Evanston, Ill.

[21] Appl. No.: 213,412

[22] Filed: Dec. 5, 1980

[51] Int. Cl.[3] ..... F01N 1/06

[52] U.S. Cl. ..... 181/230; 181/206; 181/268

[58] Field of Search ..... 181/233, 229, 251, 257, 181/268, 275, 230; 55/276; 415/119

[56] References Cited

U.S. PATENT DOCUMENTS

| | | | |
|---|---|---|---|
| 1,848,990 | 8/1927 | Boyd . | |
| 3,259,206 | 7/1966 | Straw . | |
| 3,429,397 | 2/1969 | Case . | |
| 3,592,292 | 7/1971 | Lavallee . | |
| 3,645,357 | 2/1972 | Cassel . | |
| 3,858,678 | 1/1975 | Haren . | |
| 4,165,798 | 8/1979 | Martinez | 181/268 |

FOREIGN PATENT DOCUMENTS

| | | | |
|---|---|---|---|
| 1285014 | 1/1962 | France | 181/268 |
| 235355 | 11/1944 | Switzerland | 181/268 |

*Primary Examiner*—L. T. Hix
*Assistant Examiner*—Thomas H. Tarcza
*Attorney, Agent, or Firm*—Tilton, Fallon, Lungmus

[57] ABSTRACT

A compact low-resistance muffler for reducing sound levels generated by the pulsatile flow of fluids as, for example, at the intake of a compressor or the exhaust port of an internal combustion piston engine. The muffler or suppressor comprises a pair of adjacent branch passages having a common inlet trunk and a common outlet trunk, one of the branch passages containing a flow-restricting orifice and the other of such branch passages being free of any such restriction.

13 Claims, 2 Drawing Figures

SOUND SUPPRESSOR FOR FLUID FLOW LINES

BACKGROUND AND SUMMARY

Mufflers commonly available for suppressing objectionable noise levels associated with the pulsatile flow of fluids for compressors, motors, and the like, generally have the disadvantage either of being relatively large, or of reducing flow, or both. For instance, it has long been known that orifices or flow restrictors in flow lines reduce the amplitude of pulses of fluids flowing therethrough and, hence, tend to suppress the sound levels that would otherwise be associated with such pulsatile flow; however, such orifices also have the undesirable effect of restricting flow and thereby impairing performance. Conversely, expansion chambers are known to reduce pulse levels without creating flow-reducing back pressures, but the large size of such expansion chambers makes them unsuitable for many applications. What has been needed but not heretofore available is an inexpensive muffling system that is at one and the same time efficient, compact, and free of significant flow-reducing effects.

Patents illustrative of the state of the art are U.S. Pat. Nos. 1,848,990, 3,592,292, 3,259,206, 3,645,357, 3,429,397, and 3,858,678.

It is a principal object of this invention to provide a relatively compact noise suppressor for attenuating the sounds associated with pulsatile flow without at the same time significantly reducing that flow or adversely affecting the performance of the equipment with which the suppressor is associated. A further object is to provide a low-resistance muffler or suppressor of relatively small dimensions that is particularly suitable for use in reducing the intake noise levels of vane or piston compressors, but which may also be used at the exhaust side of such compressors, or at the exhaust (or intake) ports of piston engines, or in association with any other equipment that produces pulsatile flow of gases or other fluids and creates objectionable noise levels in association with such flow.

Briefly, the muffler or sound suppressor comprises a pair of adjacent branch passages having a common inlet trunk and a common outlet trunk. One of such branch passages is free of all obstruction and is dimensioned so that it can accommodate all of the flow from the inlet trunk to the outlet trunk without producing significant back pressure. The other branch passage is similarly dimensioned except that it contains a flow restrictor in the form of a reduced orifice at an intermediate point along the length of such passage. Despite its structural simplicity and limited size, such an assembly has been found effective in attenuating the noise levels associated with pulsatile gas flow without at the same time significantly reducing that flow.

Other features, objects, and advantages of the invention will become apparent from the specification and drawings.

DRAWINGS

DETAILED DESCRIPTION

Figure 1:
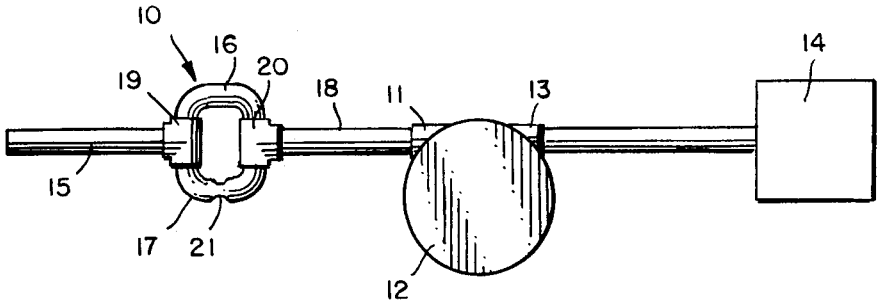
FIG. 1 is a somewhat schematic elevational view illustrating a sound suppressor embodying the invention in conjunction with a system utilizing a conventional vane-type rotary air compressor.

In the embodiment shown in the drawings, with particular reference to FIG. 1, the numeral 10 generally designates a sound suppressor or muffler connected to the inlet 11 of an air compressor 12. The outlet 13 of the compressor leads to any suitable article 14 required to be inflated or somehow treated by the compressed air. For example, such article may take the form of an inflatable bed pad as disclosed in my copending application Ser. No. 54,837, filed July 5, 1979 now U.S. Pat. No. 4,280,487, and the compressor may be a rotary vane compressor of the type marketed under the designation Model 1531 Rotary Vane Compressor by Gast Manufacturing Corporation, Benton Harbor, Michigan. Such a compressor is operated by an electric motor and produces pressure pulses at a frequency of approximately 230 cycles per second. Such pulses and the pulsating sounds they create are produced by the vanes of the compressor passing the intake port and, therefore, the objectionable noise levels of such a compressor generally emanate from the intake side. By locating muffler 10 at the inlet to compressor 12, a significant reduction in the operating noise level may be achieved.

While the muffler 10 is disclosed in conjunction with a compressor of the vane type, it is to be understood that such muffler may be effectively used with other types of pulsatile-flow compressors, and that such muffler may also be used to attenuate the sound levels generated at the exhaust port of internal combustion engines, particularly piston-type engines, which as part of their operation produce pulsatile gas flow. The term "pulsatile flow" is used herein to refer to noise-producing pulses within the frequency range of approximately 20 to 300 cycles per second, and more commonly in the range of 29 to 230 cycles per second.

The muffler 10 involves an arrangement of tubular members and essentially comprises a main inlet trunk 15 which bifurcates into a pair of passage-defining branches 16 and 17, the branches then converging to form a common outlet trunk 18. Suitable T-shaped (or Y-shaped) fittings 19 and 20 may be used at the junctions of the trunks and branches, although it is to be understood that such fittings might be eliminated by integrally forming the trunks and branches. Except as noted hereinafter, the cross sectional area of all of the passages (i.e., the trunks and branches) may be the same. It is particularly important that branch passage 16 has a cross sectional area not appreciably smaller than that of either of the trunk passages, since passage 16 should not impose any significant restriction on fluid flow.

Branch passage 17 is similar to passage 16 except that it contains a flow-restricting orifice at 21. The dimensions of the orifice may vary widely depending on the size and use of the muffler but, in general, the orifice should be small enough to create a reverse or echo pulse but not be so small as to completely dampen out the pulses of fluid flowing therethrough.

By way of example, it has been found that where the source of audible pulses is a rotary vane compressor of the type and size given above, effective results are achieved where inlet trunk 15 is approximately 7 inches long, outlet trunk 18 about 8 inches long, branch conduits 16, 17 each about 1 inch long, and the flow passages, excluding the orifice of passage 17, of all such trunks and branches about ¼ inches in inside diameter. Orifice 21 has a diameter of about 0.070 inches and a length of about 0.25 inches, and may be located any-where along the length of branch 17. Such a muffler construction has been found surprisingly effective in reducing the noise level of compressor operation approximately 10 percent without a measurable reduction in fluid flow and compressor performance. While a number of dimensions have been given in connection with this illustrative example, it is to be pointed out that some are more important than others. Thus, the length of outlet trunk 18 may be varied widely without any significant effect on the performance of the device. The length of inlet trunk 15 may also be varied but its length does alter the sound-suppressing performance of the muffler and, hence, such variations in length may be used to fine tune the system. The length of each branch conduit and its inside diameter are related to pulse frequency involved; such dimensions are believed to be particularly effective when a compressor of the type identified above is used, such compressor having a frequency of approximately 230 cycles per second. Although the orifice length may be varied somewhat, the diameter of the orifice as given above is believed to be critical for the particular frequency (230 cycles per second) involved.

Figure 2:
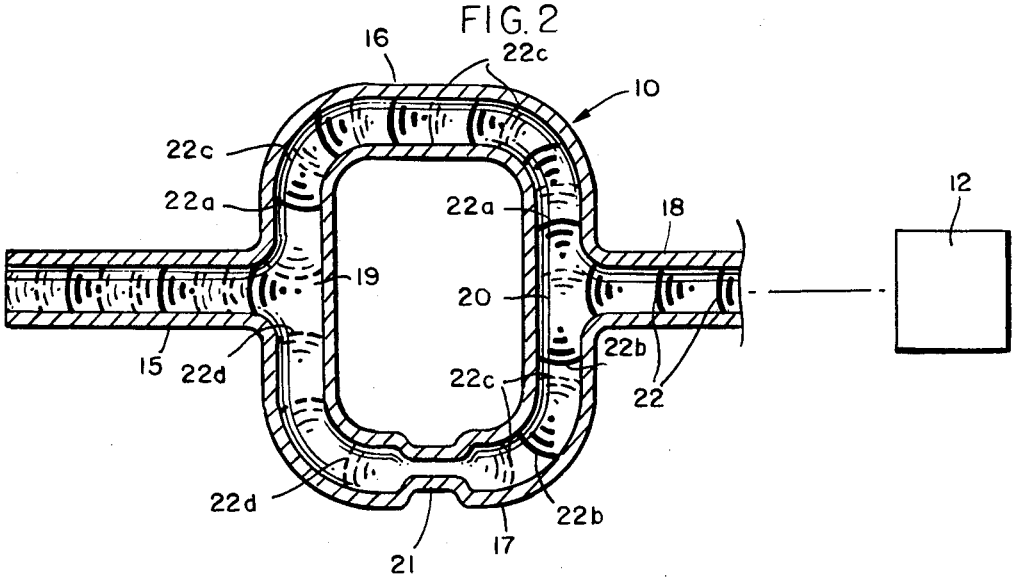
FIG. 2 is an enlarged sectional view schematically depicting a theoretical explanation of the operation of the sound suppressor.

FIG. 2 is a schematic view illustrating a theoretical explanation of the muffler's operation. Such explanation is the same regardless of whether the muffler is used to suppress inlet noise, in which case element 12 might be a compressor and flow through the muffler would be from left to right, or exhaust noise, in which case element 12 would more likely be an engine and flow through the muffler would be right to left. In either case, compression waves 22 travel from compressor or engine 12 into the passage-defining trunk 18 of the muffler 10. At tee 20, a bifurcation occurs with the pressure pulses 22*a* and 22*b* traveling in different directions into branch passages 16 and 17, respectively. When each pressure pulse 22*b* reaches orifice 21, a portion of it is reflected to produce a reversely-directed pressure pulse 22*c* represented in broken lines in FIG. 2. Another portion 22*d* passes through the orifice and continues on towards tee 19, the pressure level of the wave having been reduced by reason of orifice 21.

A sound-attenuating interaction occurs between pulses 22*c* and 22*a* in the branch passages adjacent to tee 20. Not only do pulses 22*c* and 22*a* travel in opposite directions between orifice 21 and tee 20, but they are out-of-phase in branch passage 16. A second interaction occurs at tee 19 where diminished pulses 22*d* from branch passage 17 combine with opposing pulses 22*a* and 22*c* traveling through branch passage 16. The total effect of such interactions is a leveling of the pressure waves, a diminution in pressure peaks, and a significant reduction in sound levels. Since branch passage 16 contains no orifice or flow restriction, and since its cross sectional area is not substantially less than that of trunk passages 18 and 15, such noise suppression is achieved without any appreciable resistance to flow or adverse effect on compressor (or motor) operation.

As already indicated, orifice 21 should be dimensioned to maximize effective interactions at both of the zones 19 and 20. If the orifice is too large, then the effectiveness of interaction at tee 20, and the branch passages joining it, is diminished, whereas if the orifice is too small, interaction at 19 is reduced. Specifically, to achieve effective muffler operation within the frequency range given above (20 to 300 cycles per second) the orifice should have a diameter within the range of 0.075 to 0.065 inches. Note that the relation between orifice size and pulse frequency is generally inverse with the larger orifice sizes being associated with the lower frequencies, and vice versa. Thus, a diameter of 0.070 inches has been found effective with pulse frequencies of 230 cycles per second, whereas a larger diameter of 0.073 inches has been found more suitable for lower pulse frequencies of about 29 cycles per second. Less important factors affecting the selection of a particular orifice diameter may include the length of the orifice and its location along passage 17. An increase in orifice length may allow a somewhat greater orifice diameter, whereas a shorter orifice passage may require a smaller diameter to achieve a comparable affect. Orifice location is even less significant, although it may be preferable to locate the orifice closer to interaction zone 20 than to zone 19 to promote greater cushioning or dampening effects.

While in the foregoing I have disclosed an embodiment of the invention in considerable detail for purposes of illustration, it will be understood by those skilled in the art that many of these details may be varied without departing from the spirit and scope of the invention.

I claim:

1. A low-resistance muffler for pulsatile fluid flow lines, comprising passage-providing means defining a first trunk passage adapted for communication at one end to a device capable of generating pulsatile fluid flow; a second trunk passage spaced from said first passage; and a pair of branch passages interposed between and communicating with both of said trunk passages; one of said branch passages being provided with a flow-restricting and pulse-reflecting orifice substantially smaller in cross section than elsewhere throughout said passages for partially reflecting pulses back toward said first trunk passage and into the other of said branch passages; said other of said branch passages being free of flow restriction.

2. The muffler of claim 1 in which said trunk passages are of generally the same cross-sectional area.

3. The muffler of claim 2 in which said branch passage free of flow restriction has a cross-sectional area generally the same as said trunk passages.

4. The muffler of claim 1 in which said branch passages are of generally the same cross-sectional area exclusive of said orifice.

5. The muffler of claim 4 in which said branch passages are of generally the same cross-sectional area exclusive of said orifice as said trunk passages.

6. The muffler of claims 1, 4, or 5 in which said orifice has a diameter within the range of about 0.065 to 0.075 inches.

7. A low-resistance sound suppressor for pulsatile fluid flow lines, comprising passage-providing means defining first and second trunk passages disposed in general alignment with facing ends spaced axially apart; a pair of branch passages in side-by-side relation interposed between and communicating with said trunk passages to define first and second tee zones at the junctions of said branch passages with said first and second trunk passages, respectively; one of said branch passages being of substantially uniform internal cross section throughout the length thereof; and orifice-providing flow-restricting means in the other of said branch passages; said flow-restricting means defining an orifice having a cross section substantially smaller than elsewhere throughout said passages for partially reflecting pulses back towards said first tee zone and into said one branch passage.

8. The suppressor of claim 7 in which said first trunk passage is of substantially uniform cross-sectional area throughout the length thereof.

9. The suppressor of claim 8 in which said first trunk passage and said one of said branch passages are of generally the same cross-sectional area.

10. The suppressor of claims 7, 8, or 9 in which said orifice is located closer to said first tee zone than to said second tee zone.

11. The suppressor of claims 7, 8, or 9 in which said orifice-providing branch passage has a cross section exclusive of said orifice of about the same area as said one branch passage; said orifice having a diameter within the range of about 0.065 to 0.075 inches.

12. The suppressor of claim 7 in which said first trunk passage is connected in flow communication with a device capable of generating pulsatile fluid flow, said second trunk passage having an open end opposite from the facing end thereof.

13. The structure of claim 12 in which said device is an engine or compressor capable of generating pulsatile flow at a frequency within the range of about 20 to 300 pulses per second.

* * * * *